US005628678A

United States Patent [19]

Tridico

[11] Patent Number: 5,628,678

[45] Date of Patent: May 13, 1997

[54] SHAFT SANDING DEVICE

[76] Inventor: Frank Tridico, 555 West 28th Street Unit 903, North Vancouver, British Columbia, Canada, V7N 2J7

[21] Appl. No.: 642,456

[22] Filed: May 3, 1996

[51] Int. Cl.[6] ..... B24B 21/00

[52] U.S. Cl. ..... 451/296; 451/311; 451/355; 451/453

[58] Field of Search ..... 451/296, 299, 451/301, 306, 307, 311, 310, 355, 453

[56] References Cited

U.S. PATENT DOCUMENTS

| | | | |
|---|---|---|---|
| 382,967 | 5/1888 | Fullerton | 451/311 |
| 1,248,157 | 11/1917 | Piper | 451/453 |
| 1,791,917 | 2/1931 | Winsor | 451/296 |
| 2,547,056 | 4/1951 | Stieglitz | 451/307 |
| 2,706,367 | 4/1955 | MacCarthy | 451/311 |
| 2,976,652 | 3/1961 | Bedortha et al. | 451/355 |
| 3,095,675 | 7/1963 | Gegauf | 451/311 |
| 3,415,017 | 12/1968 | Murray | 451/301 |
| 3,566,549 | 3/1971 | Britton | 451/355 |
| 4,316,349 | 2/1982 | Nelson | 451/296 |
| 5,203,118 | 4/1993 | Bocquet | 451/296 |

*Primary Examiner*—James G. Smith
*Assistant Examiner*—Dona C. Edwards

[57] ABSTRACT

A shaft sanding device including a main housing. A motor is secured within the main housing. The motor is coupled with a power source. A drive roller is secured within the main housing. The drive roller has a drive arm extending outwardly therefrom to couple with the motor. A first idle roller is secured within the main housing opposed from the drive roller. In association with the first idle roller is a second idle roller having a resilient arm rotatably coupled therewith. The resilient arm is pivotally coupled to the main housing adjacent to the motor secured therein. The resilient arm biases the second idle roller away from the main housing. A sand paper belt is disposed around the drive roller, the first idle roller, and the second idle roller.

3 Claims, 3 Drawing Sheets

FIG 3
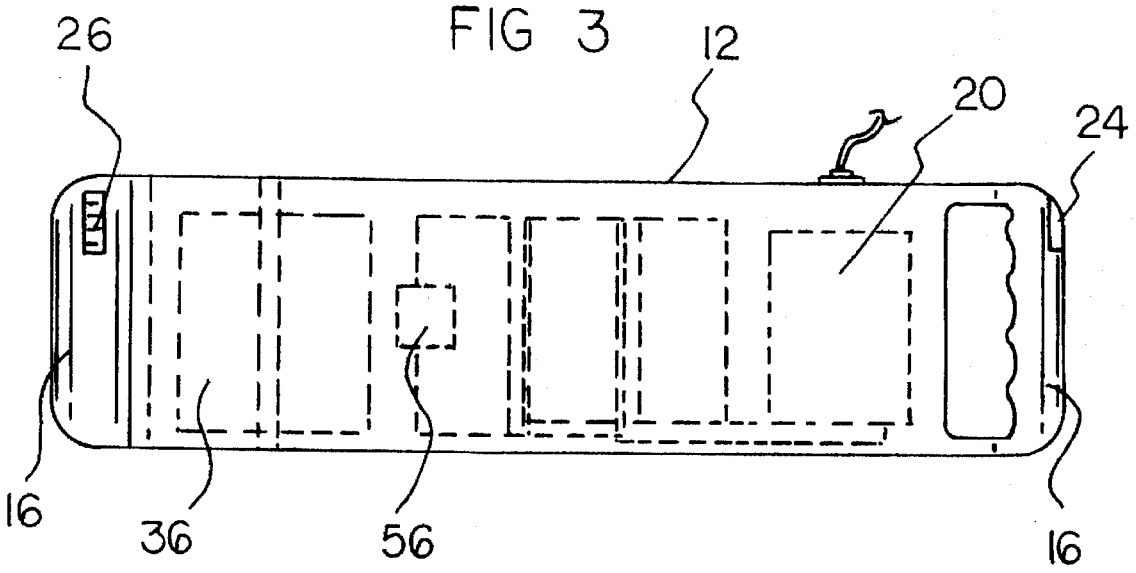
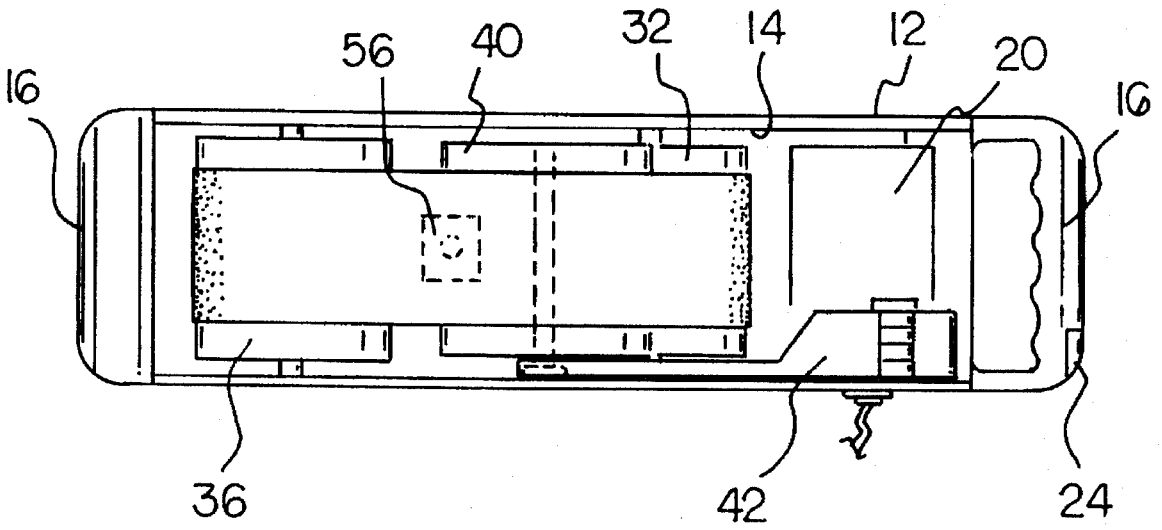
FIG 4

FIG 5
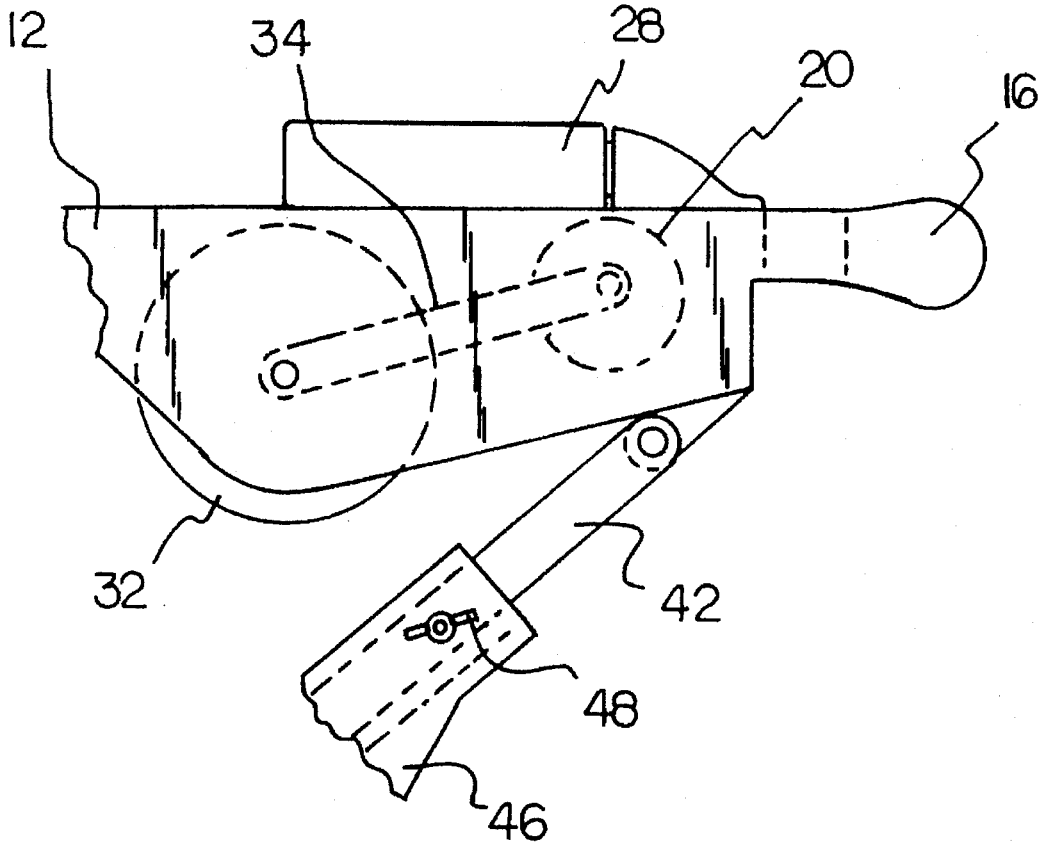
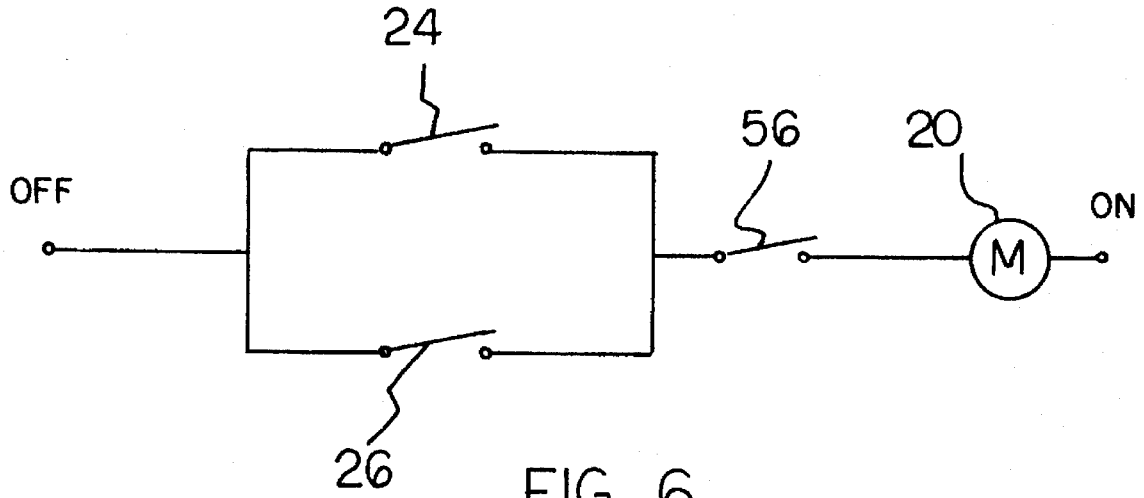
FIG 6

SHAFT SANDING DEVICE

BACKGROUND OF THE INVENTION

1. Field of the Invention

The present invention relates to a shaft sanding device and more particularly pertains to engaging a circular object to be sanded with a shaft sanding device.

2. Description of the Prior Art

The use of sanders is known in the prior art. More specifically, sanders heretofore devised and utilized for the purpose of sanding and polishing are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,335,542 to Howe discloses a combination belt and disk sander machine.

U.S. Pat. No. 3,943,669 to Stroezel discloses a gyratory sander.

U.S. Pat. No. 5,181,342 to Haney discloses a sander with orbiting platen and abrasive.

U.S. Pat. No. 4,993,192 to Demetrius discloses a power sanding device.

U.S. Pat. No. 5,263,522 to Sasko discloses an apparatus for removing bark from whole logs.

U.S. Pat. No. 5,094,281 to Barnhill et al. discloses a debarking/delimbing apparatus.

While these devices fulfill their respective, particular objective and requirements, the aforementioned patents do not describe a shaft sanding device for engaging a circular object to be sanded.

In this respect, the shaft sanding device according to the present invention substantially departs from the conventional concepts and designs of the prior art, and in doing so provides an apparatus primarily developed for the purpose of engaging a circular object to be sanded.

Therefore, it can be appreciated that there exists a continuing need for new and improved shaft sanding device which can be used for engaging a circular object to be sanded. In this regard, the present invention substantially fulfills this need.

SUMMARY OF THE INVENTION

In the view of the foregoing disadvantages inherent in the known types of sanders now present in the prior art, the present invention provides an improved shaft sanding device. As such, the general purpose of the present invention, which will be described subsequently in greater detail, is to provide a new and improved shaft sanding device and method which has all the advantages of the prior art and none of the disadvantages.

To attain this, the present invention essentially comprises a main housing comprised of a receiving chamber. The main housing has opposed end portions with a handle portion disposed thereon. A motor is secured within the receiving chamber of the main housing. The motor has a pair of power switches electrically coupled therewith. The pair of power switches are disposed within the handle portions in the opposed portions of the main housing. The motor has means for coupling with a power source. A drive roller is secured within the receiving chamber of the main housing. The drive roller has a drive arm extending outwardly therefrom to couple with the motor. A first idle roller is secured within the receiving chamber of the main housing opposed from the drive roller. The first idle roller has a diameter equal to a diameter of the drive roller. The device includes a second idle roller having a resilient arm rotatably coupled therewith. The second idle roller has a diameter equal to the diameter of the first idle roller and the drive roller. The resilient arm is pivotally coupled to the receiving chamber of the main housing adjacent to the motor secured therein. The resilient arm biases the second idle roller away from the main housing. A dust guard is removably secured to the resilient arm disposed over the second idle roller. A sand paper belt is disposed around the drive roller, the first idle roller, and the second idle roller. A limit switch is secured within the receiving chamber of the main housing intermediate the drive roller and the first idle roller. The limit switch cooperates with either of the pair of power switches for activation of the motor. The limit switch has a switch portion extending downwardly therefrom corresponding with a distal arc of the drive roller and the first idle roller.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shaft sanding device which has all the advantages of the prior art sanders and none of the disadvantages.

It is another object of the present invention to provide a new and improved shaft sanding device which may be easily and efficiently manufactured and marketed.

It is a further object of the present invention to provide a new and improved shaft sanding device which is of durable and reliable construction.

An even further object of the present invention is to provide a new and improved shaft sanding device which is susceptible of a low cost of manufacture with regard to both materials and labor, and which accordingly is then susceptible of low prices of sale to the consuming public, thereby making such a shaft sanding device economically available to the buying public.

Still yet another object of the present invention is to provide a new and improved shaft sanding device which provides in the apparatuses and methods of the prior art some of the advantages thereof, while simultaneously overcoming some of the disadvantages normally associated therewith.

Even still another object of the present invention is to provide a new and improved shaft sanding device for engaging a circular object to be sanded.

Lastly, it is an object of the present invention to provide a new and improved shaft sanding device including a main housing. A motor is secured within the main housing. The motor is coupled with a power source. A drive roller is secured within the main housing. The drive roller has a drive arm extending outwardly therefrom to couple with the motor. A first idle roller is secured within the main housing opposed from the drive roller. In association with the first idle roller is a second idle roller having a resilient arm rotatably coupled therewith. The resilient arm is pivotally coupled to the main housing adjacent to the motor secured therein. The resilient arm biases the second idle roller away from the main housing. A sand paper belt is disposed around the drive roller, the first idle roller, and the second idle roller.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view of the preferred embodiment of the present invention.

FIG. 4 is a bottom view of the preferred embodiment of the present invention.

FIG. 5 is a partial side view of the pivotal coupling between the resilient arm and the main housing.

FIG. 6 is a schematic drawing of the limit switch coupled with the power switch and the drive roller.

The same reference numerals refer to the same parts through the various Figures.

DESCRIPTION OF THE PREFERRED EMBODIMENT

Figure 1:
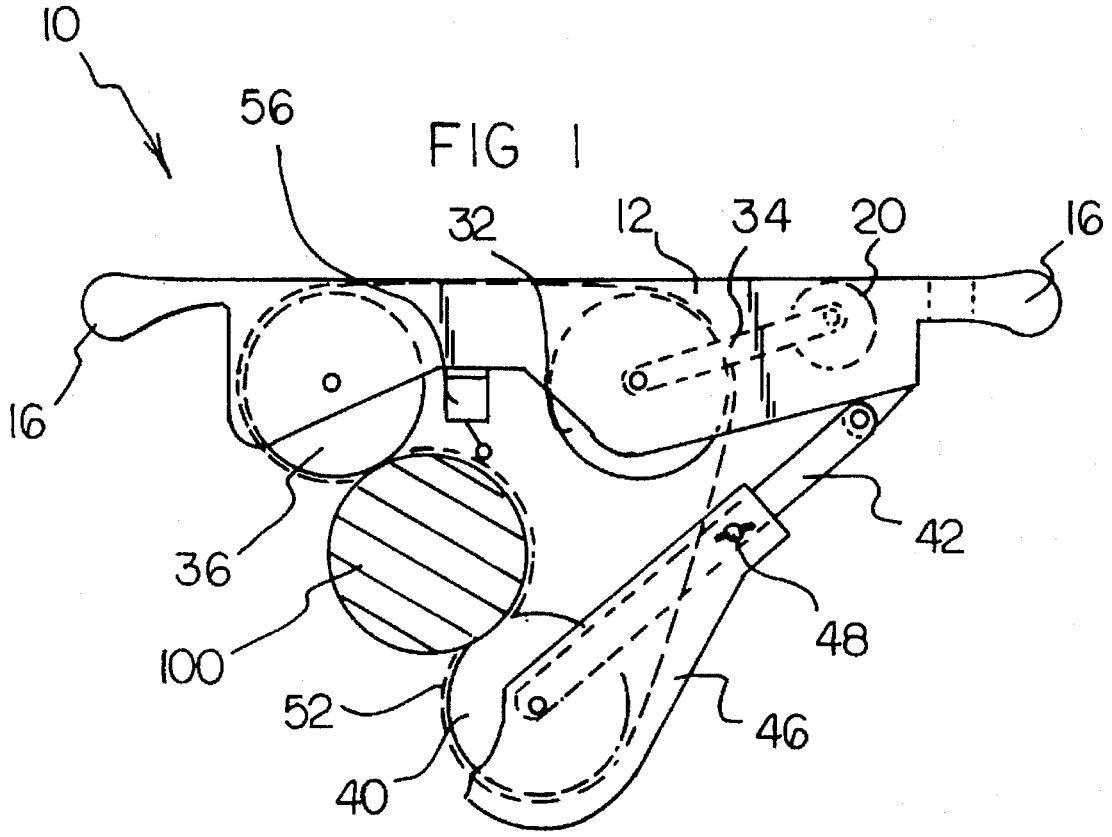
FIG. 1 is a perspective view of the preferred embodiment of the shaft sanding device constructed in accordance with the principles of the present invention.
Figure 2:
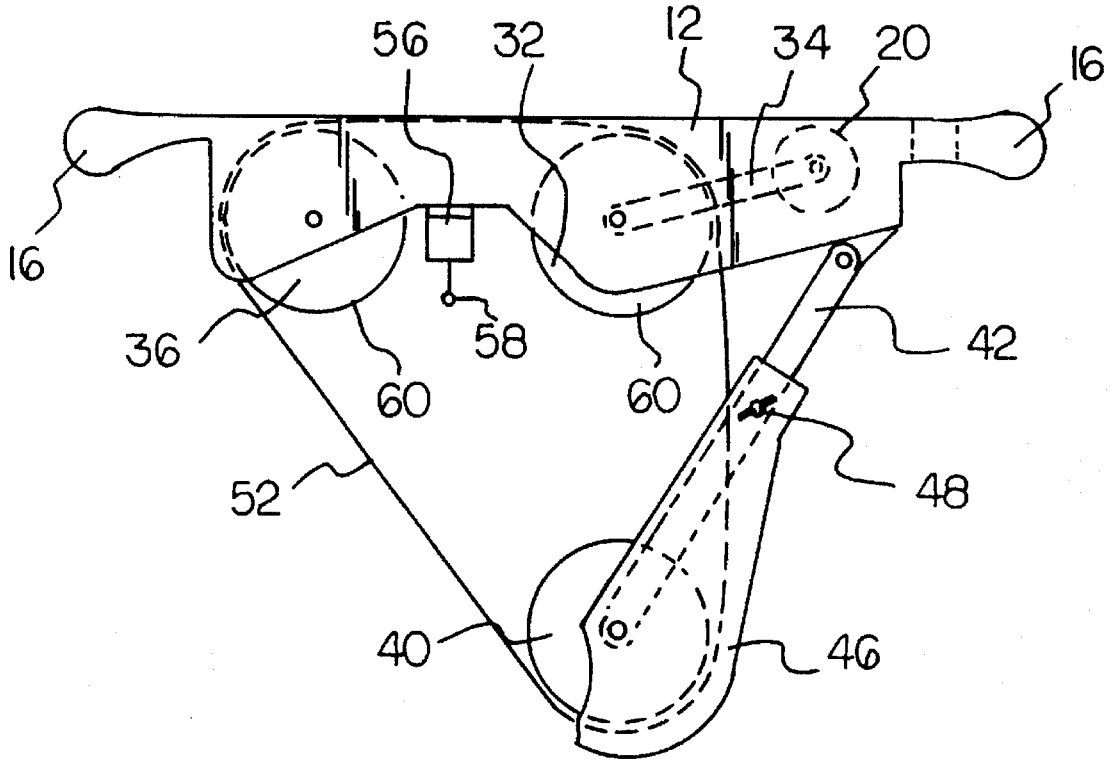
FIG. 2 is a side view of the device in an inoperable orientation.

With reference now to the drawings, and in particular, to FIGS. 1–6 thereof, the preferred embodiment of the new and improved shaft sanding device embodying the principles and concepts of the present invention and generally designated by the reference number 10 will be described.

Specifically, it will be noted in the various Figures that the device relates to a shaft sanding device for engaging a circular object to be sanded. In its broadest context, the device consists of a main housing, a drive roller, a motor, a first idle roller, a second idle roller, a dust guard, a sand paper belt and a limit switch. Such components are individually configured and correlated with respect to each other so as to attain the desired objective.

The device 10 includes a main housing 12 comprised of a receiving chamber 14. The main housing 12 has opposed end portions with a handle portion 16 disposed thereon. The main housing 12 is a generally elongated member with the receiving chamber 14 formed as a recess on the underside of the main housing 12 to allow for the coupling of components therein. The main housing 12 is preferably constructed on standard power-tool grade materials.

A motor 20 is secured within the receiving chamber 14 of the main housing 12. The motor 20 has a pair of power switches electrically coupled therewith. The power switches can be defined as a right-hand power switch 24 and a left-hand power switch 26. The pair of power switches 22 are disposed within the handle portions 16 in the opposed portions of the main housing 12. The right-hand power switch 24 is disposed on an outer portion of the handle portion 16. Note FIG. 3. The left-hand power switch 26 is disposed on an upper portion of the handle portion 16. Note FIG. 3. The motor 20 has means for coupling with a power source. The power source is preferably an electrical outlet, an air motor, or a battery. A battery pack 28 is shown secured to the main housing. Note FIG. 5.

A drive roller 32 is secured within the receiving chamber 14 of the main housing 12. The drive roller 32 has a drive arm 34 extending outwardly therefrom to couple with the motor 20. Activation of the motor 20 will simultaneously rotate the drive roller 32.

A first idle roller 36 is secured within the receiving chamber 14 of the main housing 12 opposed from the drive roller 32. The first idle roller 36 has a diameter equal to a diameter of the drive roller 32.

The device 10 includes a second idle roller 40 having a resilient arm 42 rotatably coupled therewith. The second idle roller 40 has a diameter equal to the diameter of the first idle roller 36 and the drive roller 32. The resilient arm 42 is pivotally coupled to the receiving chamber 14 of the main housing 12 adjacent to the motor 20 secured therein. The resilient arm 42 biases the second idle roller 40 away from the main housing 12. The second idle roller 40, in association with the first idle roller 36 and the drive roller 32, form a generally triangular configuration. Note FIG. 2. The second idle roller 40 can be biased inwardly to an extreme closed position abutting the first idle roller 36. The second idle roller 40 will bias outwardly to an extreme open position nearly orthogonally disposed from the first idle roller 36 and the drive roller 32.

A dust guard 46 is removably secured to the resilient arm 42 disposed over the second idle roller 40. The dust guard 46 is provided with a wing nut 48 to facilitate the easy removal of the dust guard 46 when a user in limited by space.

A sand paper belt 52 is disposed around the drive roller 32, the first idle roller 36, and the second idle roller 40. The sand paper belt 52 is sized to fit tightly around the rollers when in the extreme open position. Note FIG. 2. The sand paper belt 52 receives a shaft 100 between the first and second idle rollers 36,40. Note FIG. 1.

A limit switch 56 is secured within the receiving chamber 14 of the main housing 12 intermediate the drive roller 32 and the first idle roller 36. The limit switch 56 cooperates with either of the pair of power switches 24,26 for activation of the motor 20. Note FIG. 6. The limit switch 56 has a switch portion 58 extending downwardly therefrom corresponding with a distal arc 60 of the drive roller 32 and the first idle roller 36. The switch portion 58 will be contacted by the shaft 100 as it is wrapped around the sand paper belt 52 and in cooperation with the pressing of either of the pair of power switches 24,26 will activate the motor 20 thereby activating the drive roller 32. This will cause the sand paper belt 52 to rotate around the shaft 100 performing a sanding function contacting approximately 180 degrees of the circumference of the shaft 100. This will provide for a quick and easy smoothing of the shaft 100, or small reductions in diameter.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A shaft sanding device for engaging a circular object to be sanded comprising, in combination:

a main housing comprised of a receiving chamber, the main housing having opposed end portions with a handle portion disposed thereon;

a motor secured within the receiving chamber of the main housing, the motor having a pair of power switches electrically coupled therewith, the pair of power switches disposed within the handle portions in the opposed portions of the main housing, the motor having means for coupling with a power source;

a drive roller secured within the receiving chamber of the main housing, the drive roller having a drive arm extending outwardly therefrom to couple with the motor;

a first idle roller secured within the receiving chamber of the main housing opposed from the drive roller, the first idle roller having a diameter equal to a diameter of the drive roller;

a second idle roller having a resilient arm rotatably coupled therewith, the second idle roller having a diameter equal to the diameter of the first idle roller and the drive roller, the resilient arm pivotally coupled to the receiving chamber of the main housing adjacent to the motor secured therein, the resilient arm biasing the second idle roller away from the main housing;

a dust guard removably secured to the resilient arm disposed over the second idle roller;

a sand paper belt disposed around the drive roller, the first idle roller, and the second idle roller; and a limit switch secured within the receiving chamber of the main housing intermediate the drive roller and the first idle roller, the limit switch cooperating with either of the pair of power switches for activation of the motor, the limit switch having a switch portion extending downwardly therefrom corresponding with a distal arc of the drive roller and the first idle roller.

2. A shaft sanding device comprising:

a main housing;

a motor secured within the main housing, the motor having means for coupling with a power source, the motor having a pair of power switches electrically coupled therewith, the pair of power switches disposed within handle portions in opposing end portions of the main housing;

a drive roller secured within the main housing, the drive roller having a drive arm extending outwardly therefrom to couple with the motor;

a first idle roller secured within the main housing opposed from the drive roller;

a second idle roller having a resilient arm rotatably coupled therewith, the resilient arm pivotally coupled to the main housing adjacent to the motor secured therein, the resilient arm biasing the second idle roller away from the main housing;

a sand paper belt disposed around the drive roller, the first idle roller, and the second idle roller; and a dust guard removably secured to the resilient arm disposed over the second idle roller.

3. The shaft sanding device as set forth in claim 2 and further including a limit switch secured within the main housing intermediate the drive roller and the first idle roller, the limit switch cooperating with either of the pair of power switches for activation of the motor, the limit switch having a switch portion extending downwardly therefrom corresponding with a distal arc of the drive roller and the first idle roller.

* * * * *